US010130967B2

(12) United States Patent
Garza

(10) Patent No.: US 10,130,967 B2
(45) Date of Patent: Nov. 20, 2018

(54) PORTABLE SHOWER DEVICE

(71) Applicant: Ramiro Garza, Cutler, FL (US)

(72) Inventor: Ramiro Garza, Cutler, FL (US)

( * ) Notice: Subject to any disclaimer, the term of this patent is extended or adjusted under 35 U.S.C. 154(b) by 211 days.

(21) Appl. No.: 15/087,284

(22) Filed: Mar. 31, 2016

(65) Prior Publication Data

US 2017/0282197 A1 Oct. 5, 2017

(51) Int. Cl.

| | |
|---|---|
| ***B05B 9/00*** | (2006.01) |
| ***B05B 15/30*** | (2018.01) |
| ***B05B 9/08*** | (2006.01) |
| ***A47K 3/28*** | (2006.01) |

(52) U.S. Cl.

CPC ..... *B05B 15/30* (2018.02); *A47K 3/288* (2013.01); *B05B 9/007* (2013.01); *B05B 9/0816* (2013.01)

(58) Field of Classification Search

CPC ..... B05B 11/0037; B05B 11/0013; B05B 11/0029; B05B 11/0097; B05B 11/3039; B05B 11/3052; B05B 11/3061; B05B 11/3063; B05B 9/007; B05B 9/0816; B05B 9/0822; B05B 15/30; E03C 2001/0415; E03C 2001/0417; A47K 3/288

USPC ..... 239/373, 146, 147; 4/602, 603, 616, 615

See application file for complete search history.

(56) References Cited

U.S. PATENT DOCUMENTS

| | | | | |
|---|---|---|---|---|
| 4,104,744 | A * | 8/1978 | Odencrantz | A45F 3/00 239/373 |
| 5,090,214 | A | 2/1992 | LoGioco | |
| 5,251,345 | A * | 10/1993 | Pechner | A47K 3/325 4/603 |
| 5,771,934 | A * | 6/1998 | Warshawsky | E03C 1/0401 137/801 |
| 5,911,520 | A | 6/1999 | Kenney | |
| 5,978,983 | A | 11/1999 | Queen et al. | |
| 6,463,756 | B1 * | 10/2002 | Lewis | A45D 19/02 62/371 |
| 7,814,586 | B1 * | 10/2010 | Samuels | A47K 3/288 4/612 |
| 8,887,322 | B1 | 11/2014 | Adrian | |
| 2007/0107120 | A1 | 5/2007 | Ingraham | |
| 2010/0108781 | A1 * | 5/2010 | Terrizzi | B08B 3/026 239/332 |
| 2010/0199418 | A1 * | 8/2010 | Yi | A45D 19/04 4/516 |
| 2013/0305449 | A1 * | 11/2013 | Allos | B05B 1/24 4/616 |

* cited by examiner

*Primary Examiner* — Darren W Gorman
*Assistant Examiner* — Juan C Barrera

(57) ABSTRACT

A portable shower device for portable showering purposes includes a tank that defines an internal space. The tank is configured to store water. A hose is sealably coupled to and extends from the tank. The hose is fluidically coupled to the internal space. A spray head is coupled to an external end of the hose. A pump is sealably coupled to the tank. The pump is configured to pressurize the tank such that water is motivated through the hose to the spray head. A pair of axles is singly and rotationally coupled to a bottom of the tank proximate to a back and a front of the tank. Wheels are coupled singly to each opposing end of each axle. A handle is positioned on the front of the tank for grasping by a user to motivate the tank upon the wheels.

15 Claims, 4 Drawing Sheets

PORTABLE SHOWER DEVICE

BACKGROUND OF THE DISCLOSURE

Field of the Disclosure

The disclosure relates to shower devices and more particularly pertains to a new shower device for portable showering purposes.

SUMMARY OF THE DISCLOSURE

An embodiment of the disclosure meets the needs presented above by generally comprising a tank that defines an internal space. The tank is configured to store water. A hose is sealably coupled to and extends from the tank. The hose is fluidically coupled to the internal space. A spray head is coupled to an external end of the hose. A pump is sealably coupled to the tank. The pump is configured to pressurize the tank such that water is motivated through the hose to the spray head. A pair of axles is singly and rotationally coupled to a bottom of the tank proximate to a back and a front of the tank. Wheels are coupled singly to each opposing end of each axle. A handle is positioned on the front of the tank for grasping by a user to motivate the tank upon the wheels.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
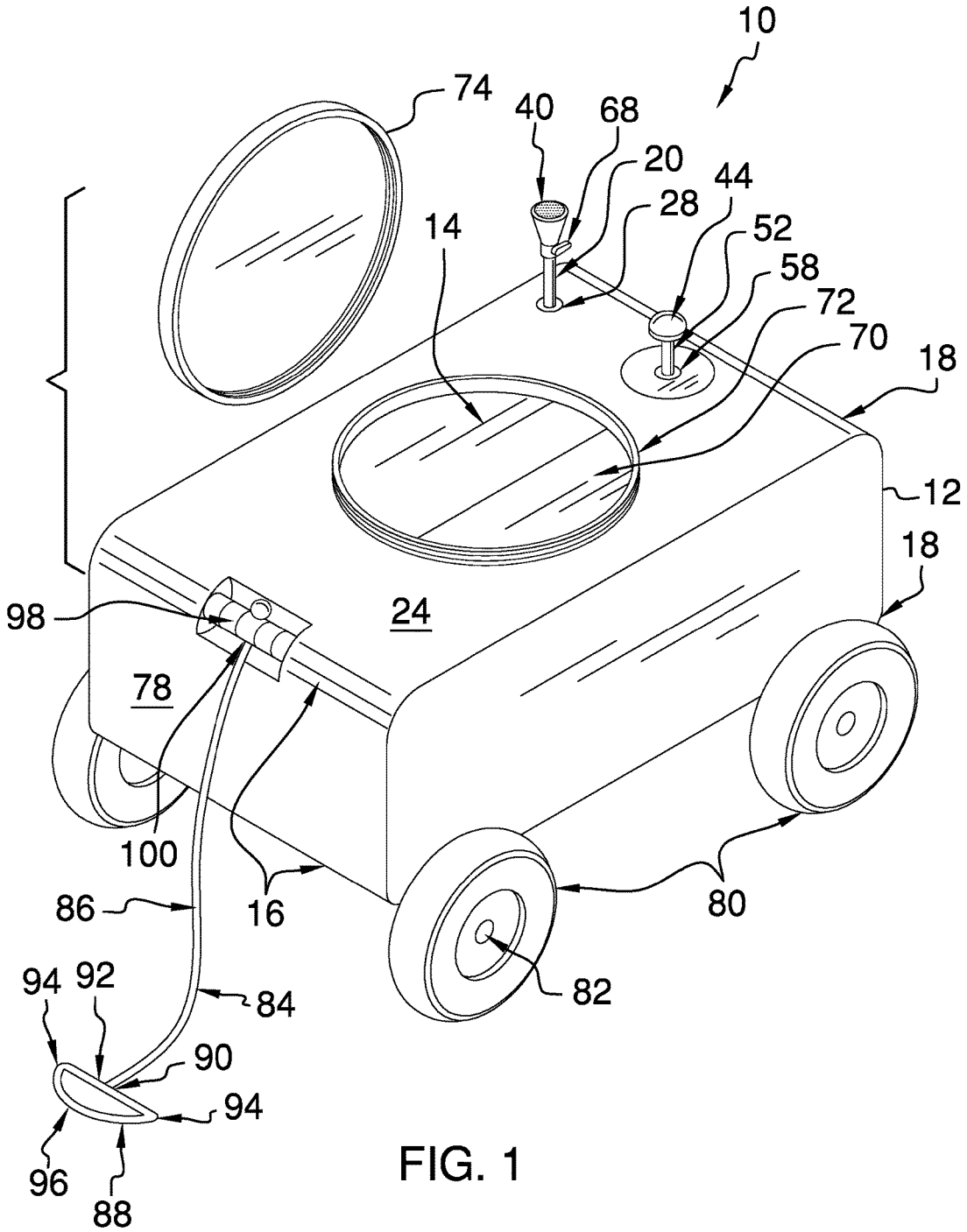
FIG. 1 is an isometric perspective view of a portable shower device according to an embodiment of the disclosure.
Figure 2:
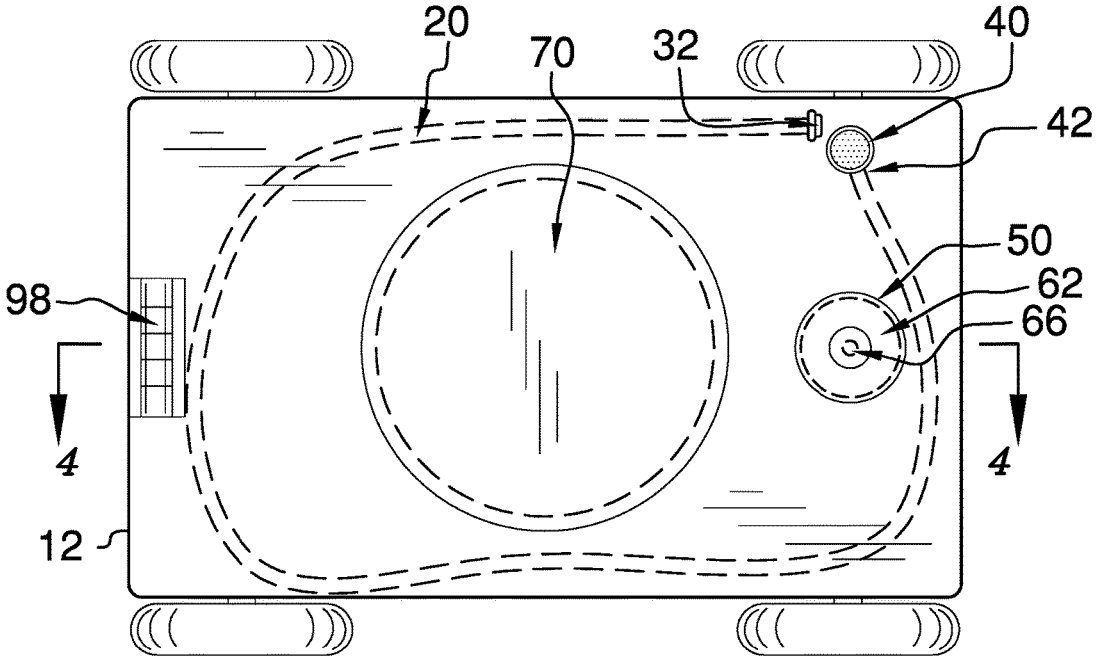
FIG. 2 is a top view of an embodiment of the disclosure.
Figure 3:
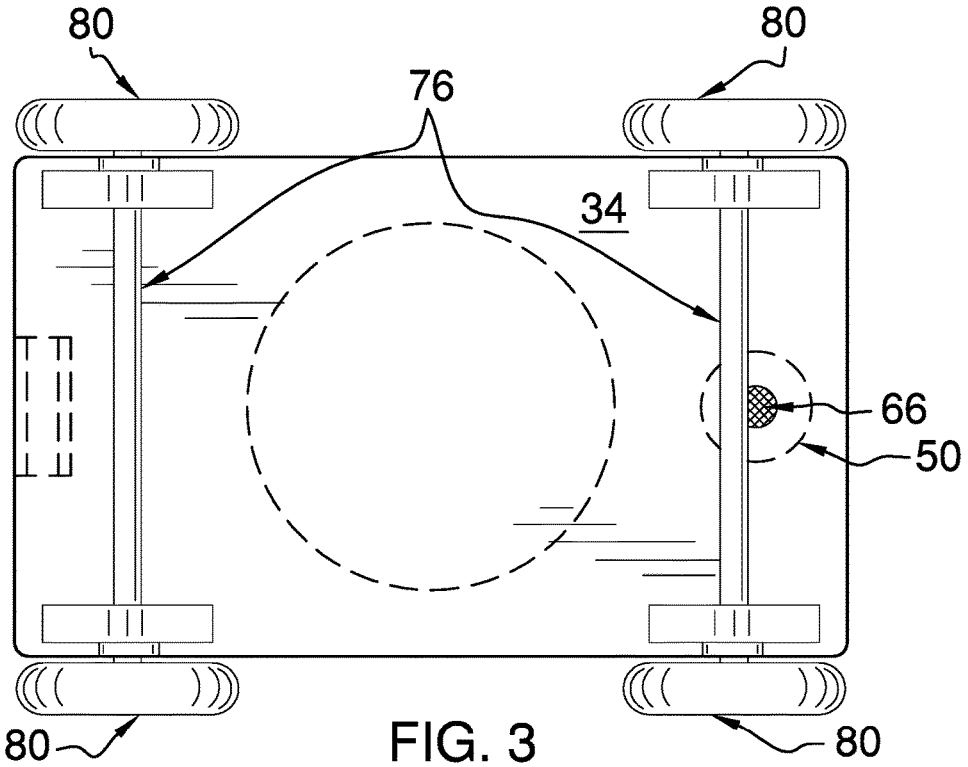
FIG. 3 is a bottom view of an embodiment of the disclosure.
Figure 4:
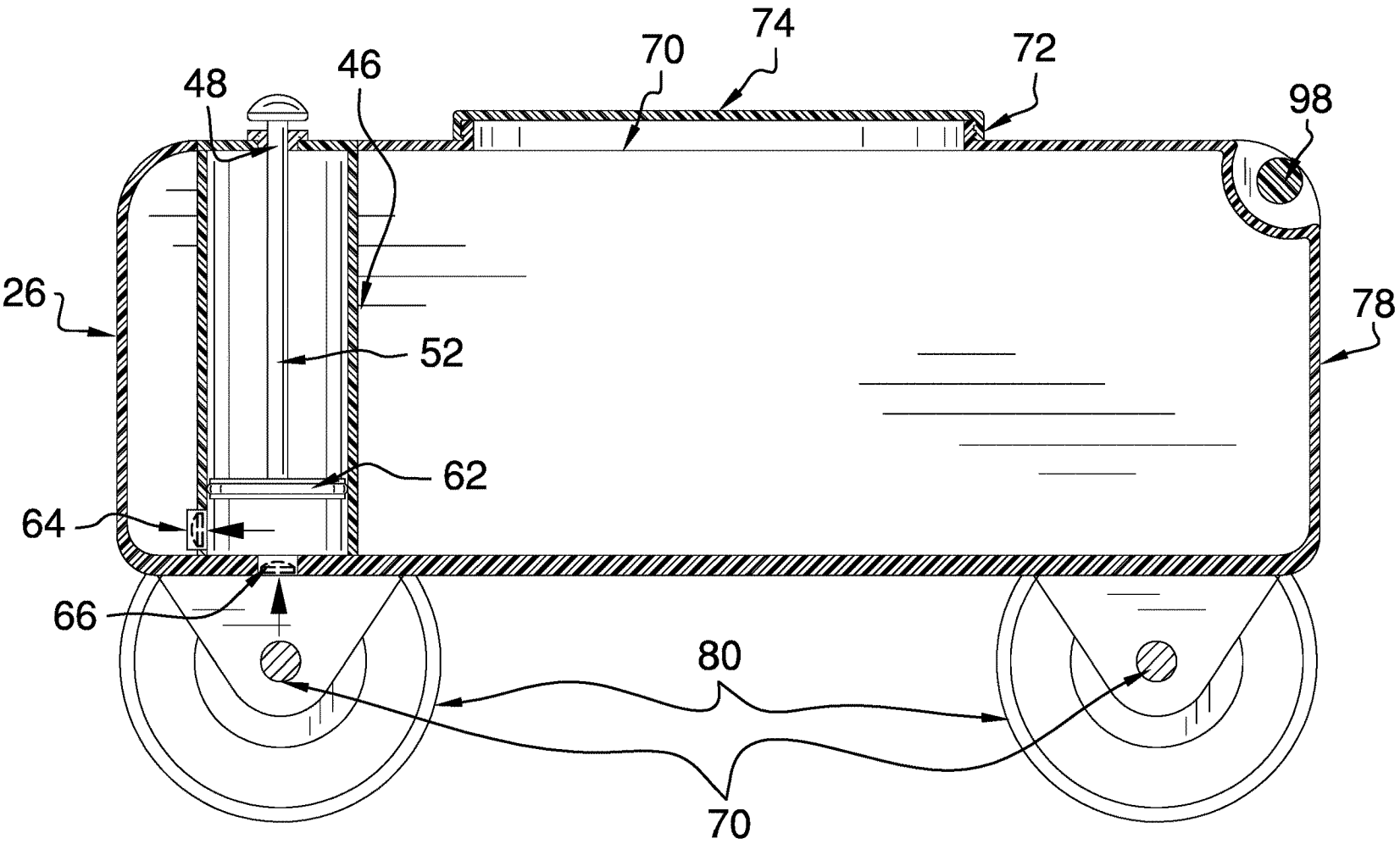
FIG. 4 is a cross-sectional view of an embodiment of the disclosure.
Figure 5:
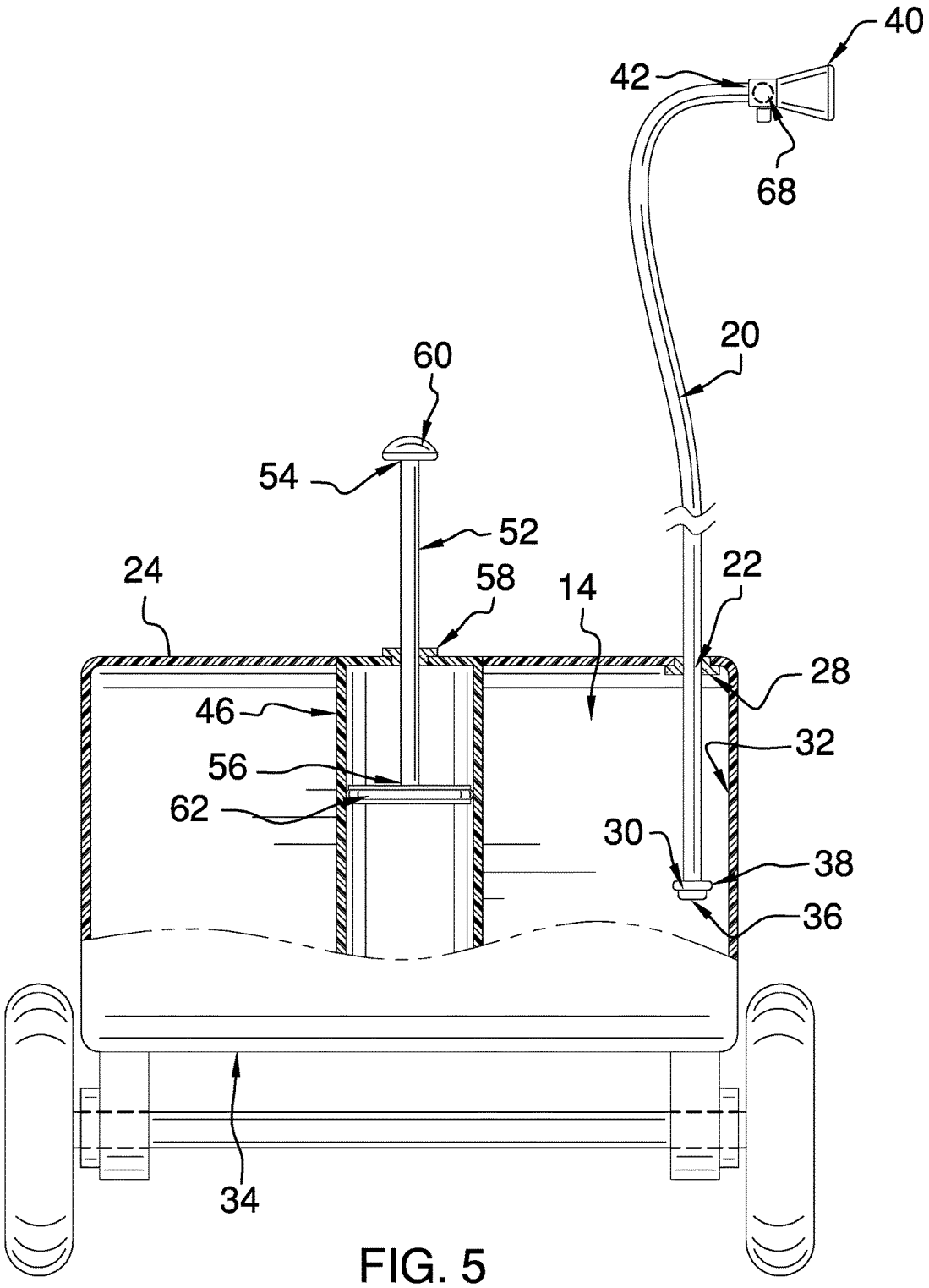
FIG. 5 is a partial cross-sectional view of an embodiment of the disclosure.

With reference now to the drawings, and in particular to FIGS. 1 through 5 thereof, a new shower device embodying the principles and concepts of an embodiment of the disclosure and generally designated by the reference numeral 10 will be described.

As best illustrated in FIGS. 1 through 5, the portable shower device 10 generally comprises a tank 12 that defines an internal space 14. The tank 12 is configured to store water. The tank 12 is substantially rectangularly box shaped. The tank 12 has horizontal front edges 16 and horizontal back edges 18. The horizontal front edges 16 and the horizontal back edges 18 are rounded.

A hose 20 is sealably coupled to and extends from the tank 12. The hose 20 is fluidically coupled to the internal space 14. The hose 20 extends from a penetration 22 positioned through a top 24 of the tank 12 proximate to a back 26 of the tank 12. A first seal 28 is positioned in the penetration 22 and coupled to the tank 12. The first seal 28 is positioned to sealably couple to the hose 20 as the hose 20 is slidably positioned relative to the tank 12.

A stop 30 is coupled to an internal surface 32 of the tank 12 proximate to a bottom 34 of the tank 12. The stop 30 is operationally coupled to the hose 20. The stop 30 is positioned on the internal surface 32 such that an internal end 36 of the hose 20 is prevented from passing the stop 30 as the hose 20 is extended from the internal space 14. In one embodiment, the stop 30 comprises a ring 38 that is coupled to the internal surface 32 of the tank 12. The ring 38 is complementary to the hose 20. The internal end 36 of the hose 20 is dimensionally larger than the ring 38, such that the internal end 36 is prevented from passing through the ring 38 as the hose 20 is extended from the internal space 14.

A spray head 40 is coupled to an external end 42 of the hose 20. The spray head 40 is cone shaped. A pump 44 is sealably coupled to the tank 12. The pump 44 is configured to pressurize the tank 12 such that water is motivated through the hose 20 to the spray head 40. The pump 44 is positioned proximate to the back 26 of the tank 12.

In one embodiment, the pump 44 comprises a cylinder 46 positioned in the internal space 14. The cylinder 46 is coupled to and extends between the top 24 and the bottom 34 of the tank 12. A hole 48 is positioned through the top 24 of the tank 12. The hole 48 is centrally positioned relative to an interior circumference 50 of the cylinder 46. The pump 44 also comprises a shaft 52 that has a first end 54 and a second end 56. The shaft 52 is sealably and slidably positioned through the hole 48. The first end 54 is positioned above the top 24. The second end 56 is positioned in the cylinder 46. A second seal 58 is positioned in the hole 48 and coupled to the tank 12. The second seal 58 is positioned to sealably couple to the shaft 52 as the shaft 52 is slidably positioned relative to the tank 12.

A knob 60 is coupled to the first end 54 of the shaft 52. The knob 60 is hemi-spherically shaped. A plunger 62 is coupled to the second end 56 of the shaft 52. The plunger 62 is complementary to the interior circumference 50 of the cylinder 46. The plunger 62 is sealably and slidably positioned within the cylinder 46. A first one-way valve 64 is positioned through the cylinder 46 proximate to the bottom 34 of the tank 12. A second one-way valve 66 is positioned through the bottom 34 of the tank 12 within the interior circumference 50 of the cylinder 46. The first one-way valve 64 is positioned through the cylinder 46 such that air is movable from the cylinder 46 to the internal space 14 as the plunger 62 is motivated downwardly. The second one-way valve 66 is positioned through the bottom 34 such that air is movable into the cylinder 46 as the plunger 62 is motivated upwardly.

The spray head 40 comprises a valve 68 that is positioned adjacent to the external end 42 of the hose 20. Water flow through the hose 20 is controllable by a user turning the valve 68.

An opening 70 is positioned in the top 24 of the tank 12. The opening 70 is positioned in the top 24 so that water can be added to the internal space 14 of the tank 12. The opening 70 is circular. The opening 70 comprises a rim 72 that extends upwardly from the top 24 of the tank 12. The rim 72 is externally threaded. The device 10 comprises a cap 74 that is complementary to the opening 70. The cap 74 is couplable to the tank 12 to reversibly seal the opening 70. The cap 74 is internally threaded.

A pair of axles 76 is singly and rotationally coupled to the bottom 34 of the tank 12 proximate to the back 26 and a front 78 of the tank 12. A set of four wheels 80 is coupled singly to each opposing end 82 of each axle 76.

A handle 84 is pivotally coupled to the front 78 of the tank 12. The handle is positioned on the tank 12 such that the handle is configured to be grasped by the user to motivate the tank 12 upon the wheels 80. In one embodiment, the handle 84 comprises a rod 86. The rod 86 is arcuate. A grasp 88 is coupled to a first terminus 90 of the rod 86. The grasp 88 comprises a first bar 92 coupled to the rod 86 equally distant from opposing endpoints 94 of the first bar 92. The grasp 88 comprises a second bar 96 that extends curvedly between the opposing endpoints 94 of the first bar 92. A pivot bar 98 is pivotally coupled to the tank 12 proximate to the front 78 and the top 24. The pivot bar 98 is coupled to a second terminus 100 of the rod 86.

In use, the opening 70 is positioned in the top 24 so that water can be added to the internal space 14 of the tank 12. The pump 44 is configured to pressurize the tank 12 such that water is motivated through the hose 20 to the spray head 40. The hose 20 is slidably positionable relative to the tank 12 so the user can position the spray head 40 as required for use. Water flow through the hose 20 is controllable by the user turning the valve 68. The pivot bar 98 is positioned on the tank 12 such that the handle 84 is positioned to be grasped by the user to motivate the tank 12 upon the wheels 80.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable shower device comprising:

a tank defining an internal space, wherein said tank is configured for storing water;

a hose sealably coupled to and extendable from said tank, wherein said hose is fluidically coupled to said internal space;

a spray head coupled to an external end of said hose;

a pump sealably coupled to said tank, wherein said pump is configured to pressurize said tank such that water is motivated through said hose to said spray head;

a pair of axles singly and rotationally coupled to a bottom of said tank proximate to a back and a front of said tank, said internal space of said tank extends between said pair of axles;

a set of four wheels coupled singly to each opposing end of each said axle; and a handle pivotally coupled to said front of said tank, wherein said handle is positioned on said tank such that said handle is configured for grasping by the user to motivate said tank upon said wheels.

2. The device of claim 1, further including said tank being substantially rectangularly box shaped.

3. The device of claim 2, further including said tank having horizontal front edges and horizontal back edges, said horizontal front edges and said horizontal back edges being rounded.

4. The device of claim 1, further comprising:

said hose being extendable from a penetration positioned through a top of said tank proximate to said back of said tank;

a first seal positioned in said penetration and coupled to said tank; and wherein said first seal is positioned to sealably couple to said hose as said hose is slidably positioned relative to said tank.

5. The device of claim 1, further including a stop coupled to an internal surface of said tank proximate to said bottom of said tank, said stop being operationally coupled to said hose, wherein said stop is positioned on said internal surface such that an internal end of said hose is prevented from passing said stop as said hose is extended from said internal space.

6. The device of claim 5, further comprising:

said stop comprising a ring coupled to said internal surface of said tank, said ring being complementary to said hose;

said internal end of said hose being dimensionally larger than said ring; and wherein said internal end is prevented from passing through said ring as said hose is extended from said internal space.

7. The device of claim 1, further including said spray head being cone shaped.

8. The device of claim 1, further including said pump being positioned proximate to said back of said tank.

9. The device of claim 1, further including said pump comprising:

a cylinder positioned in said internal space, said cylinder being coupled to and extending between a top and said bottom of said tank;

a hole positioned through said top of said tank, said hole being centrally positioned relative to an interior circumference of said cylinder;

a shaft having a first end and a second end, said shaft being sealably and slidably positioned through said hole, said first end being positioned above said top, said second end being positioned in said cylinder;

a second seal positioned in said hole and coupled to said tank, wherein said second seal is positioned to sealably couple to said shaft as said shaft is slidably positioned relative to said tank;

a knob coupled to said first end of said shaft;

a plunger coupled to said second end of said shaft, said plunger being complementary to said interior circumference of said cylinder, said plunger being sealably and slidably positioned within said cylinder;

a first one-way valve positioned through said cylinder proximate to said bottom of said tank;

a second one-way valve positioned through said bottom of said tank within said interior circumference of said cylinder; and wherein said first one-way valve is positioned through said cylinder such that air is movable from said cylinder to said internal space as said plunger is motivated downwardly, such that said second one-way valve is positioned through said bottom such that air is movable into said cylinder as said plunger is motivated upwardly.

10. The device of claim 9, further including said knob being hemi-spherically shaped.

11. The device of claim 1, further including said spray head comprising a valve, wherein said valve is positioned adjacent to said external end of said hose such that water flow through said hose is controllable by the user.

12. The device of claim 1, further comprising:

an opening positioned in a top of said tank, wherein said opening is positioned in said top such that water can be added to said internal space of said tank; and a cap complementary to said opening, wherein said cap is couplable to said tank to reversibly seal said opening.

13. The device of claim 12, further comprising:

said opening being circular, said opening comprising a rim extending upwardly from said top of said tank, said rim being externally threaded; and said cap being internally threaded.

14. The device of claim 1, further including said handle comprising:

a rod, said rod being arcuate;

a grasp coupled to a first terminus of said rod, said grasp comprising a first bar coupled to said rod equally distant from opposing endpoints of said first bar, said grasp comprising a second bar extending curvedly between said opposing endpoints of said first bar;

a pivot bar pivotally coupled to said tank proximate to said front and a top of said tank, said pivot bar being coupled to a second terminus of said rod; and wherein said pivot bar is positioned on said tank such that said handle is positioned for grasping by the user to motivate said tank upon said wheels.

15. A portable shower device comprising:

a tank defining an internal space, wherein said tank is configured for storing water, said tank being substantially rectangularly box shaped, said tank having horizontal front edges and horizontal back edges, said horizontal front edges and said horizontal back edges being rounded;

a hose sealably coupled to and extendable from said tank, wherein said hose is fluidically coupled to said internal space, said hose being extendable from a penetration positioned through a top of said tank proximate to a back of said tank;

a first seal positioned in said penetration and coupled to said tank, wherein said first seal is positioned to sealably couple to said hose as said hose is slidably positioned relative to said tank;

a stop coupled to an internal surface of said tank proximate to a bottom of said tank, said stop being operationally coupled to said hose, wherein said stop is positioned on said internal surface such that internal end of said hose is prevented from passing said stop as said hose is extended from said internal space, said stop comprising a ring coupled to said internal surface of said tank, said ring being complementary to said hose, said internal end of said hose being dimensionally larger than said ring, such that said internal end is prevented from passing through said ring as said hose is extended from said internal space;

a spray head coupled to an external end of said hose, said spray head being cone shaped;

a pump sealably coupled to said tank, wherein said pump is configured to pressurize said tank such that water is motivated through said hose to said spray head, said pump being positioned proximate to a back of said tank, said pump comprising:

a cylinder positioned in said internal space, said cylinder being coupled to and extending between said top and said bottom of said tank, a hole positioned through said top of said tank, said hole being centrally positioned relative to an interior circumference of said cylinder, a shaft having a first end and a second end, said shaft being sealably and slidably positioned through said hole, said first end being positioned above said top, said second end being positioned in said cylinder, a second seal positioned in said hole and coupled to said tank, wherein said second seal is positioned to sealably couple to said shaft as said shaft is slidably positioned relative to said tank, a knob coupled to said first end of said shaft, said knob being hemi-spherically shaped, a plunger coupled to said second end of said shaft, said plunger being complementary to said interior circumference of said cylinder, said plunger being sealably and slidably positioned within said cylinder, a first one-way valve positioned through said cylinder proximate to said bottom of said tank, a second one-way valve positioned through said bottom of said tank within an interior circumference of said cylinder, and wherein said first one-way valve is positioned through said cylinder such that air is movable from said cylinder to said internal space as said plunger is motivated downwardly, such that said second one-way valve is positioned through said bottom such that air is movable into said cylinder as said plunger is motivated upwardly;

said spray head comprising a valve, wherein said valve is positioned adjacent to said external end of said hose such that water flow through said hose is controllable by the user, an opening positioned in said top of said tank, wherein said opening is positioned in said top such that water can be added to an internal space of said tank, said opening being circular, said opening comprising a rim extending upwardly from said top of said tank, said rim being externally threaded;

a cap complementary to said opening, wherein said cap is couplable to said tank to reversibly seal said opening, said cap being internally threaded;

a pair of axles singly and rotationally coupled to said bottom of said tank proximate to said back and said front of said tank, said internal space of said tank extends between said pair of axles;

a set of four wheels coupled singly to each opposing end of each said axle;

a handle pivotally coupled to said front of said tank, wherein said handle is positioned on said tank such that said handle is configured for grasping by the user to motivate said tank upon said wheels, said handle comprising:

a rod, said rod being arcuate, a grasp coupled to a first terminus of said rod, said grasp comprising a first bar coupled to said rod equally distant from opposing endpoints of said first bar, said grasp comprising a second bar extending curvedly between said opposing endpoints of said first bar, a pivot bar pivotally coupled to said tank proximate to said front and said top, said pivot bar being coupled to a second terminus of said rod, and wherein said pivot bar is positioned on said tank such that said handle is positioned for grasping by the user to motivate said tank upon said wheels.

* * * * *